US009491986B1

(12) United States Patent
Dixon et al.

(10) Patent No.: US 9,491,986 B1
(45) Date of Patent: Nov. 15, 2016

(54) HIGH-HEELED SHOE

(75) Inventors: Christopher Dixon, Fayetteville, NC (US); Joshua Ward, Raeford, NC (US); Cortland Finnegan, Brentwood, TN (US)

(73) Assignee: F.W.D. LLC, Fayetteville, NC (US)

( * ) Notice: Subject to any disclaimer, the term of this patent is extended or adjusted under 35 U.S.C. 154(b) by 396 days.

(21) Appl. No.: 13/301,474

(22) Filed: Nov. 21, 2011

Related U.S. Application Data

(60) Provisional application No. 61/415,446, filed on Nov. 19, 2011.

(51) Int. Cl.

| | |
|---|---|
| ***A43B 13/14*** | (2006.01) |
| ***A43B 21/00*** | (2006.01) |
| ***A43B 7/16*** | (2006.01) |
| ***A43B 21/06*** | (2006.01) |
| ***A43B 21/36*** | (2006.01) |
| ***A43B 21/24*** | (2006.01) |

(52) U.S. Cl.
CPC ..... *A43B 21/24* (2013.01)

(58) Field of Classification Search
CPC ..... A43B 21/00; A43B 21/24
USPC ..... 36/34 A, 34 B, 35 R, 36 A, 92, 99, 105, 36/149
See application file for complete search history.

(56) References Cited

U.S. PATENT DOCUMENTS

| | | | | | |
|---|---|---|---|---|---|
| 1,761,021 | A | * | 6/1930 | Nutt | A43B 21/00 36/24.5 |
| D121,671 | S | * | 7/1940 | Cocozella | 36/34 R |
| 2,328,319 | A | * | 8/1943 | Barton | A43B 21/00 264/301 |
| D136,960 | S | | 1/1944 | Shuford | |
| 2,414,445 | A | * | 1/1947 | Cahill | A43B 23/227 36/149 |
| 2,925,671 | A | | 2/1960 | del Giudice et al. | |
| 2,934,840 | A | | 5/1960 | Mistarz | |
| D190,221 | S | | 5/1961 | Fabian | |
| 3,041,745 | A | * | 7/1962 | Dittrich | A43B 21/24 36/34 R |
| D194,204 | S | | 12/1962 | Taicher et al. | |
| D199,388 | S | | 10/1964 | Ishida et al. | |
| D201,002 | S | * | 5/1965 | Hahn | D2/966 |
| 3,199,233 | A | * | 8/1965 | Steinbock | A43B 13/28 36/24.5 |
| D205,882 | S | * | 10/1966 | Post | 36/34 R |
| 3,369,309 | A | * | 2/1968 | Brooks | A43B 21/24 36/34 R |
| 3,514,879 | A | * | 6/1970 | Frattallone | A43B 21/46 36/42 |
| D255,618 | S | * | 7/1980 | Artstein | D2/950 |
| D259,298 | S | * | 5/1981 | Famolare, Jr. | D2/950 |

(Continued)

OTHER PUBLICATIONS

Lewis, Joseph E., double heel stiletto product web site, available at http://josephelewis.com, downloaded Mar. 14, 2011.

*Primary Examiner* — Clinton T Ostrup
*Assistant Examiner* — Cameron A Carter
(74) *Attorney, Agent, or Firm* — Stites & Harbison, PLLC; Terry L. Wright; James R. Hayne

(57) ABSTRACT

A high-heeled shoe is provided that includes a base with a receiving area defined in the ball support portion of the base and a cushioning insert positioned in the receiving area. The shoe further includes a support assembly that includes a first heel and a second heel, and is attached to the bottom surface of the base. The first heel and the second heel can be positioned on the support assembly such that the first heel and the second heel are aligned with one another, or the first heel and the second heel can be positioned on the support assembly such that the first heel and the second heel are angled with the first heel crossing the second heel.

10 Claims, 6 Drawing Sheets

(56) References Cited

U.S. PATENT DOCUMENTS

| | | | | | |
|---|---|---|---|---|---|
| D278,094 | S | | 3/1985 | Rousian | |
| D302,003 | S | * | 7/1989 | McKeon | D12/211 |
| D347,937 | S | * | 6/1994 | Garland | D2/965 |
| 5,918,384 | A | * | 7/1999 | Meschan | A43B 3/0042 36/27 |
| D563,638 | S | | 3/2008 | Guers-Neyrud | |
| D578,286 | S | * | 10/2008 | Hogan | D2/947 |
| D580,642 | S | * | 11/2008 | Guers-Neyraud | D2/965 |
| D580,643 | S | * | 11/2008 | Guers-Neyraud | D2/965 |
| D590,143 | S | | 4/2009 | Guers-Neyraud | |
| 7,574,819 | B2 | * | 8/2009 | Rie | A43B 21/24 36/34 R |
| D605,840 | S | | 12/2009 | Schwartz | |
| D606,730 | S | | 12/2009 | Whittington | |
| D612,590 | S | | 3/2010 | Guers-Neyraud | |
| D631,647 | S | | 2/2011 | Hipshman | |
| D632,469 | S | | 2/2011 | Guers-Neyraud | |
| D635,750 | S | | 4/2011 | Whittington | |
| D647,291 | S | | 10/2011 | Ringholz | |
| D709,683 | S | * | 7/2014 | Sookdeo | D2/965 |
| 2007/0074430 | A1 | * | 4/2007 | Coomer | A43B 7/141 36/145 |
| 2008/0047165 | A1 | * | 2/2008 | Keen | A43B 3/22 36/50.1 |
| 2008/0060226 | A1 | | 3/2008 | Rie | |
| 2009/0094856 | A1 | * | 4/2009 | Guerra | A43B 7/1425 36/29 |
| 2010/0000127 | A1 | * | 1/2010 | Feller | A43B 1/0081 36/101 |
| 2011/0154687 | A1 | * | 6/2011 | Bonilla-Espada | A43B 5/12 36/8.3 |
| 2011/0185601 | A1 | * | 8/2011 | Hampton | A43B 23/00 36/72 B |

* cited by examiner

HIGH-HEELED SHOE

RELATED APPLICATIONS

This application claims priority from U.S. Provisional Application Ser. No. 61/415,446, filed Nov. 19, 2011, the entire disclosure of which is incorporated herein by this reference.

TECHNICAL FIELD

The present invention relates to a high-heeled shoe and, more particularly, to a high-heeled shoe that includes two high heels and a multi-layered cushioning insert to provide a high-heeled shoe having increased stability and comfort.

BACKGROUND

Despite warnings from various physicians and podiatrists, high-heeled shoes are more frequently being worn by women due to the increased role that fashion is playing in many women's lives and in today's society. However, this increased wearing of high-heeled shoes, which are generally defined as pumps that include heels of more than two inches, has resulted in a number of problems. Indeed, recent research by the American Orthopedic Foot and Ankle Society regarding women's shoes and, in particular, high-heeled shoes has revealed that: nine out of ten women wear shoes that are too small for their feet; eight out of ten women say their shoes are painful; more than seven out of ten women report developing a bunion, hammertoe, or other painful deformity due to improper shoes; women are more likely to develop a foot problem because of improper fitting shoes; and, nine out of ten foot deformities in women can be attributed to tight-fitting shoes.

High-heeled shoes often include pointed toes and thin soles, and thus commonly cause crowding of the toes of a woman, while offering little if any support. In this regard, a quick turn or a stumble by a woman wearing high-heeled shoes can easily lead to her becoming off-balance and, consequently, put her at risk for a fall, a turned ankle, or worse. Additionally, it is not uncommon for frequent wearers of high-heeled shoes to experience pain in the balls of their feet and to develop blisters, corns, calluses, back pain, and aching heels, in addition to various deformities such as bunions, claw toes, and thickening of the nails, or even more serious orthopedic problems such as osteochondritis, metatarsalgia, and sesamoiditis.

It is known that high-heeled shoes typically distribute the wearer's body weight unevenly, thus placing excess stress on the ball of the foot and the forefoot. It is also known that the height of the heel itself can cause a dramatic difference in the pressure that occurs on the bottom of the foot. Indeed, as the height of the heel increases, the amount of pressure placed on the forefoot increases as well and can, in some cases, more than double.

Despite the available knowledge regarding high-heeled shoes, currently-available high-heeled shoe designs have failed to alleviate the problems experienced by many women. To date, a high-heeled shoe has yet to be sufficiently provided that blends fashion appeal with comfort, and people suffering from various problems as a result of wearing high-heeled shoes continue to simply be instructed to seek out comfortable, low-heeled shoes. However, those types of shoes are frequently unattractive and/or difficult to find, making them an unsuitable alternative to high-heeled shoes.

SUMMARY

The presently-disclosed relates to a high-heeled shoe that includes two high heels and a multi-layered cushioning insert located in a ball support portion of the shoe to provide a high-heeled shoe having increased stability and comfort.

In one exemplary embodiment, a high-heeled shoe is provided that includes a base having a rear portion, an arch portion, and a substantially horizontal ball support portion, where the rear portion and the arch portion of the base are sloped at an angle relative to the substantially horizontal ball support portion. The high-heeled shoe further includes a receiving area that is defined in the ball support portion of the base and is used to house a cushioning insert that is positioned in the receiving area. The high-heeled shoes also includes a support assembly having an upper surface, a first heel, and a second heel, where the upper surface of the support assembly is attached to the bottom surface of the rear portion of the base and is further attached to the bottom surface of the arch portion of the base.

To provide the wearer of the shoe with an increased amount of comfort when the high-heeled shoes of the present invention are worn, in some embodiments, the cushioning insert is comprised of a plurality of cushioning layers that provide an increased cushioning effect, while still providing a supportive structure in the ball support portion of the shoe. In some embodiments, each cushioning layer is comprised of a material selected from the group consisting of latex, foam resins, cork, or combinations thereof. For example, in certain embodiments, the plurality of cushioning layers includes a top foam resin (e.g., ethylene vinyl acetate (EVA)) layer, a middle latex layer, and a bottom cork layer.

To further provide the wearer of the shoe with an increased amount of comfort and to also provide an increased amount of stability when the shoes are worn, in some embodiments, the first heel of the shoe is positioned on the support assembly adjacent to the rear portion of the base and the second heel of the shoe is positioned on the support assembly adjacent to the arch portion of the base such that the first heel and the second heel are aligned with one another. In other embodiments, to provide an increased amount of comfort and stability, the first heel and the second heel of the shoe are positioned on the support assembly adjacent to the rear portion of the base and are angled relative to one another such that the first heel crosses the second heel.

In some embodiments of the present invention, the stability of the shoe is also increased by providing a cap for the first heel and a cap for the second heel that each include a bottom face and that each define a hollow interior configured to fit over an end of each heel. In some embodiments, the caps are connected to one another. In certain embodiments, the bottom face of each cap is wider than a diameter of each heel to further provide an increased amount of stability.

As a refinement to the shoes of the present invention, in some embodiments, the support assembly further includes a pad that is positioned on the upper surface of the support assembly and includes a plurality of cushioning layers to provide further comfort to the wearer of the shoe. In this regard, when the pad is included in the support assembly, the pad is positioned into an aperture defined in the rear portion of the base such that, once the support assembly is attached to the base, the pad is positioned to be placed in contact with the wearer of the shoe.

To complete the appearance of the shoe, a uniform cover is also included on the shoes of the present invention over the cushioning insert and the rear portion, the arch portion, and the substantially horizontal ball support portion of the base of the shoe. In certain embodiments, an additional comfort layer is positioned beneath the cover of the shoe and extends from the rear portion of the base to the substantially horizontal ball support portion of the base of the shoe to thereby provide yet an additional layer of comfort to the wearer. However, regardless of whether that layer is included in the shoe, the appearance of the shoe is, of course, completed by including an upper portion on the shoe that is configured to cover the foot of a wearer.

Further features and advantages of the present invention will become evident to those of ordinary skill in the art after a study of the description, figures, and non-limiting examples in this document.

DESCRIPTION OF EXEMPLARY EMBODIMENTS

The present invention is a high-heeled shoe that includes two high heels and a multi-layered cushioning insert to provide increased stability and comfort to the wearer of the shoe.

Figure 1:
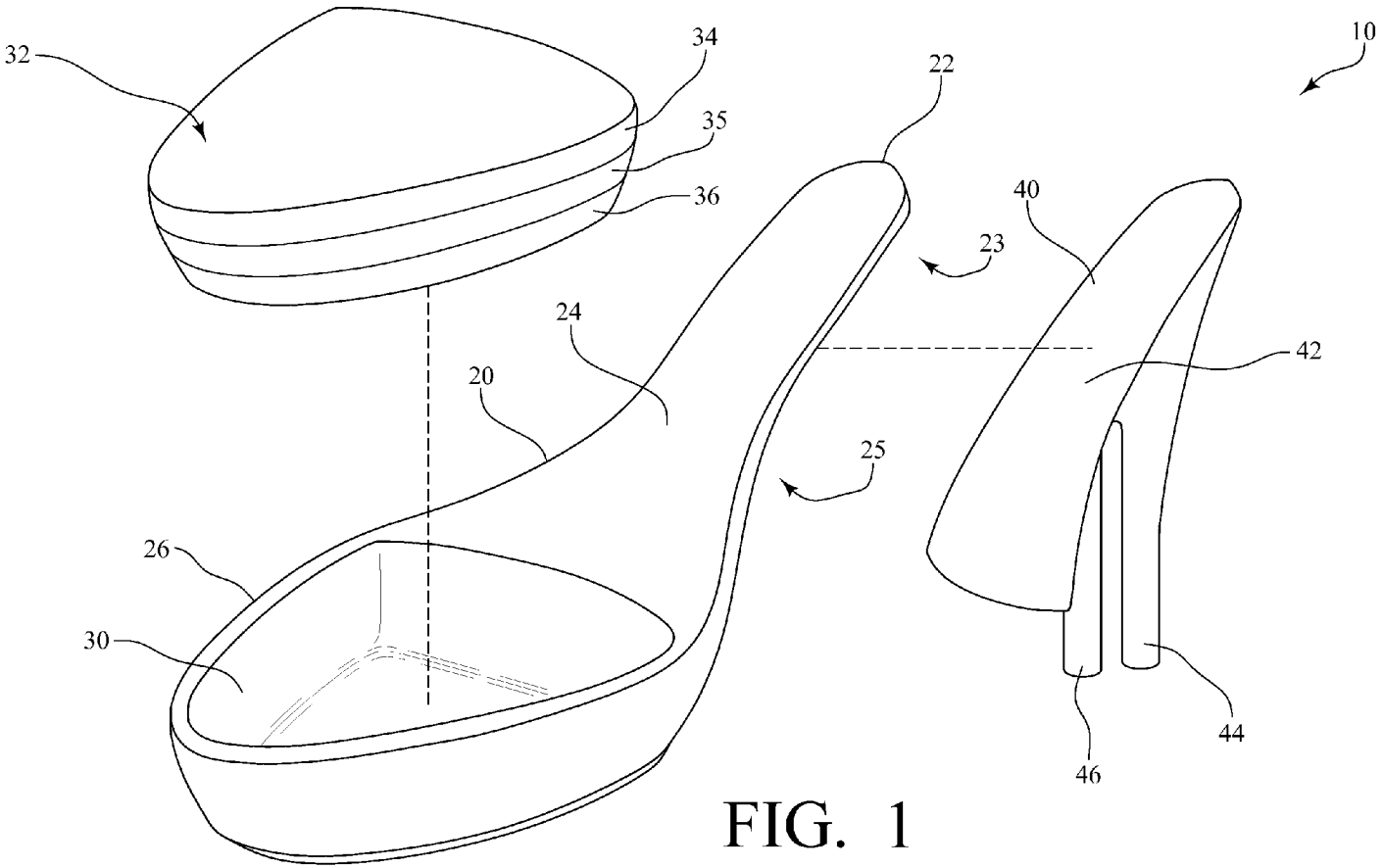
FIG. 1 is an exploded perspective view of an exemplary high-heeled shoe made in accordance with the present invention.
Figure 2:
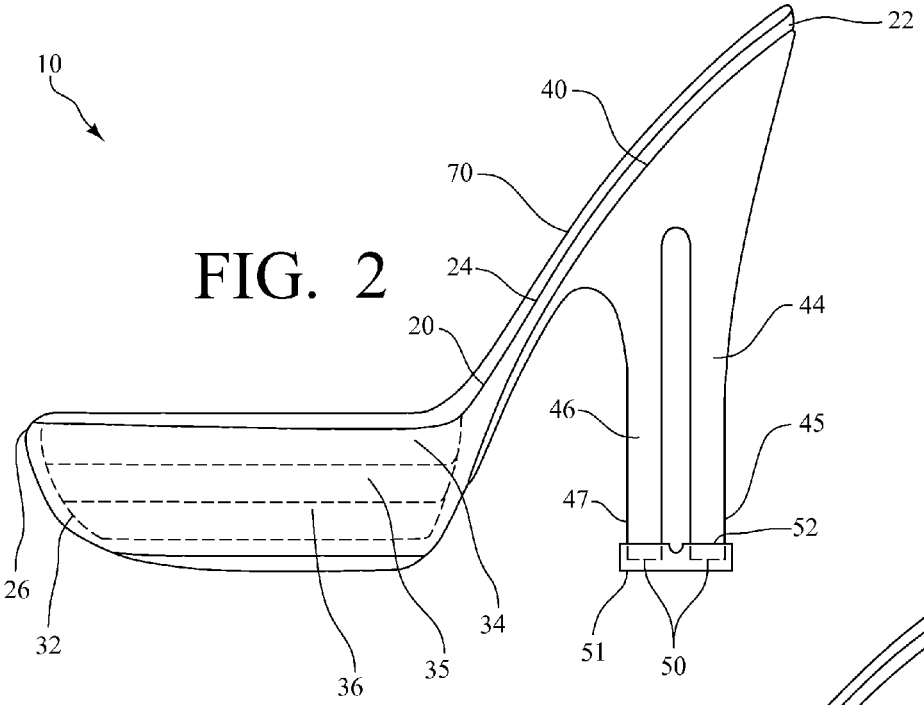
FIG. 2 is a left side view of the exemplary high-heeled shoe illustrated in FIG. 1, but showing the shoe in an assembled form and showing the various layers of the cushioning insert.

Referring first to FIGS. 1 and 2, in one exemplary embodiment of a high-heeled shoe made in accordance with the present invention, the high-heeled shoe 10 includes a base 20 having a rear portion 22, an arch portion 24, and a substantially horizontal ball support portion 26. The rear portion 22 and the arch portion 24 of the base 20 are sloped at an angle relative to the substantially horizontal ball support portion 26 such that both the arch portion 24 and the rear portion 22 of the base 20 are higher than the ball support portion 26. Various materials known to those of ordinary skill in the art can be used to construct the base 20. Typically, the base 20 is comprised of a single material having a sufficient hardness such that the base 20 retains its shape and provides a suitable frame for assembling the remaining portions of the high-heeled shoe 10. The base 20 can also be comprised of multiple materials, including composite materials and the like that can readily be configured for use in forming the base 20.

Regardless of the particular material used to construct the base 20, however, the high-heeled shoe 10 further includes a receiving area 30 that is defined in the ball support portion 26 of the base 20. As shown in FIG. 1, the receiving area 30 is generally a bowl-shaped feature that is formed by the ball support portion 26 of the base 20. In the shoe 10, the receiving area 30 defines a triangular-shaped volume such that the receiving area 30 and the ball support portion 26 have a shape that is similar to that commonly observed in other high-heeled shoes.

Figure 7:
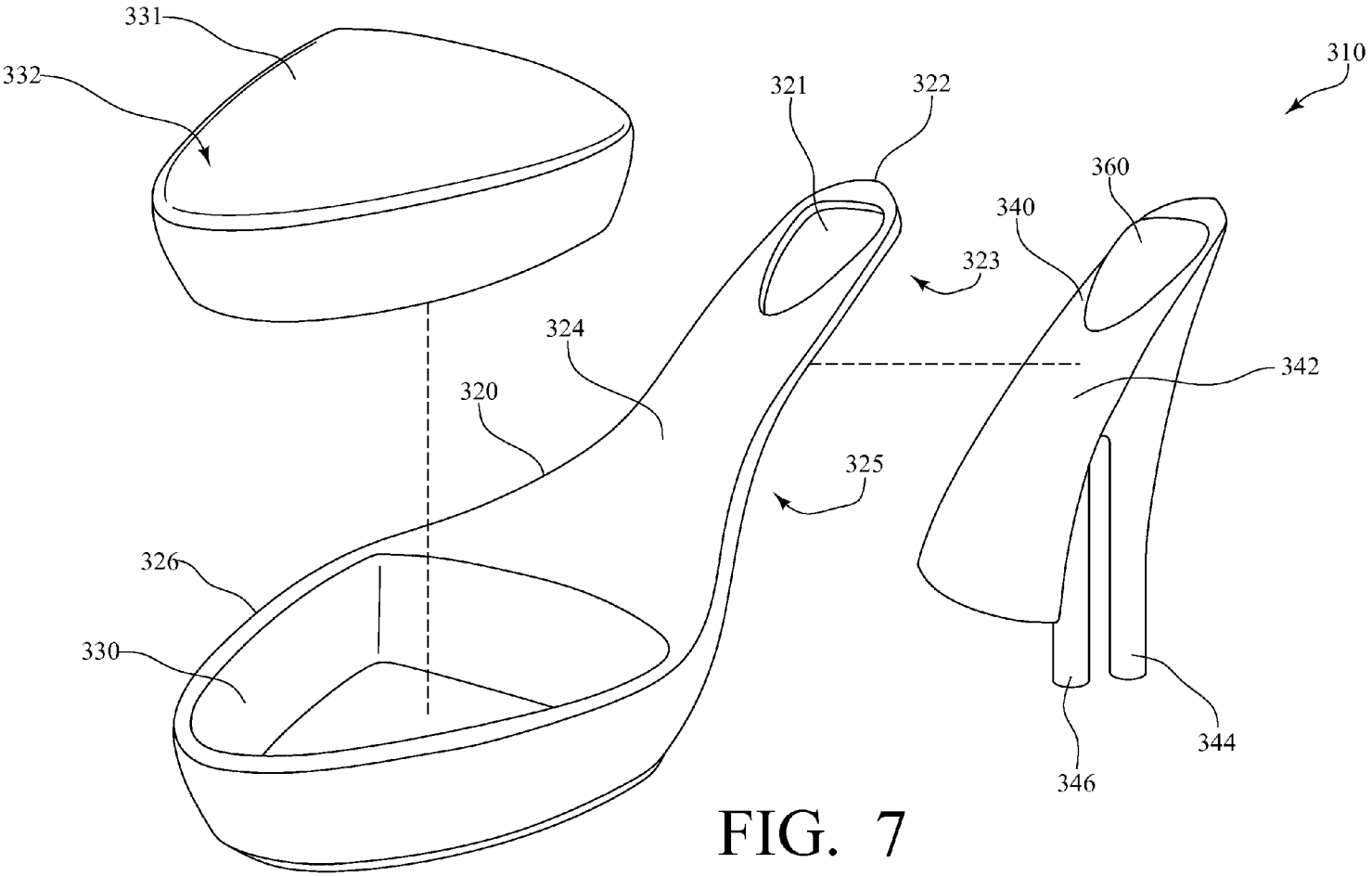
FIG. 7 is an exploded perspective view of another exemplary high-heeled shoe similar to the high-heeled show of FIGS. 1 and 2, but showing an outer case covering the cushioning insert and also showing a pad positioned in the upper surface of the support assembly and an aperture defined in the rear portion of the base of the shoe.

Referring still to FIGS. 1 and 2, the high-heeled shoe 10 further includes a cushioning insert 32 in a shape that corresponds to the receiving area 30 (e.g., generally triangular). Typically, the cushioning insert 32 is secured within the receiving area 30 using cement or another suitable adhesive to thereby bond the cushioning insert 32 and the receiving area 30 together. Of course, a number of other suitable means for attaching the cushioning insert 32 and the receiving area 30 together can also be used without departing from the spirit and scope of the subject matter described herein. For example, in some embodiments, it is contemplated that hook and loop fasteners (not shown) can be used such that the cushioning insert 32 can be placed into the receiving area 30 and secured into place, but can also be removed and replaced by a new insert as the original cushioning insert 32 becomes worn. In this regard, as shown in FIG. 7, in some embodiments, the cushioning insert 332 is covered by an outer case 331 such that the cushioning insert 332 can be easily inserted and removed from the receiving area 330 of the ball support portion of 326 of the shoe 310.

Irrespective of the particular means used to secure a cushioning insert in the receiving area and irrespective of whether a cushioning insert includes an outer case, however, and referring again to FIGS. 1 and 2, the cushioning insert 32 is positioned in the receiving area 30 to provide cushioning to the ball of a woman's foot when the high-heeled shoe 10 is worn. In this regard, the cushioning insert 32 is generally comprised of a plurality of layers in order to provide an increased cushioning effect, while also providing a supportive structure in the ball support portion 26 of the shoe 10.

Various materials can be used to construct the layers of the cushioning insert 32, including, but not limited to, latex, foam resins (e.g., ethylene vinyl acetate (EVA); or Croslite®, Crocs, Inc.), cork, carbon fiber or combinations thereof. For example, in the embodiment shown in FIGS. 1-2, the cushioning insert 32 is comprised of a top foam resin layer 34 (e.g., EVA), a middle latex layer 35, and a bottom cork layer 36 to provide a cushioning insert that provides a wearer with an increased level of comfort. In other embodiments of the present invention, the cushioning insert can also include one or more durable layers and/or one or more rigid layers to provide a cushioning insert that is not only comfortable, but is also durable. In this regard, in some embodiments, the cushioning insert can be comprised of a top durable layer of material, one or more interior cushioning layers of material, and a bottom rigid layer. For example, in the some embodiments, the cushioning insert can include: a top leather layer as the durable layer; a latex layer, a foam resin layer, and a cork layer as interior cushioning layers; and a carbon fiber layer as a bottom rigid layer.

Of course, the height of the cushioning insert 32 can vary depending on the desired level of cushioning and the desired height or appearance of the ball support portion 26 of the base 20. In some embodiments, when increased cushioning or a ball support portion 26 having an increased height is desired, the thickness of each layer of the cushioning insert 32 can be increased and used to fill the entire depth of the receiving area 30. In other embodiments, and as shown in FIG. 3, when a minimal amount of cushioning or a ball support portion 126 having a minimal height is desired, the thickness of each layer of the cushioning insert 132 can be decreased such that the cushioning insert 132 fits in a receiving area 130 that is lower in height due to the minimal height of the ball support portion 126.

Referring again to FIGS. 1 and 2, the high-heeled shoe 10 also includes a support assembly 40 that includes an upper surface 42, a first heel 44, and a second heel 46. The upper surface 42 of the support assembly 40 is attached to a bottom surface 23 of the rear portion 22 of the base 20 and to a bottom surface 25 of the arch portion 24 of the base 20. Typically, the upper surface 42 of the support assembly 40 is attached to the base 20 using cement or another suitable adhesive to thereby bond the components of the shoe 10 together. Of course, it is contemplated that a number of other suitable means for attaching the components together can also be used without departing from the spirit and scope of the subject matter described herein.

By providing a support assembly 40 that includes a first heel 44 and a second heel 46, the high-heeled shoe 10 is advantageously capable of providing a wearer with both an increased amount of stability and an increased amount of comfort. In high-heeled shoe constructions employing only one heel, sudden movements or turns can frequently cause the wearer of the shoe to lose their balance, which often results in falls, turned ankles, or worse. Furthermore, those high-heeled shoe constructions also frequently cause the wearer to develop various orthopedic conditions as the heel of the wearer is only being supported by one heel and the wearer's body weight is being distributed unevenly such that an increased amount of pressure is applied to certain parts of the wearer's foot. By using a support assembly 40 that includes a first heel 44 and a second heel 46, when the wearer makes a sudden turn, the wearer is not pivoting on a single heel, and thus, the wearer is provided with an increased amount of stability. Additionally, the two-heeled construction of the shoe 10 works to provide the wearer with an increased amount of weight distribution to thereby assist in reducing the orthopedic issues that frequently arise with high-heeled shoe constructions employing only one heel.

Figure 3:
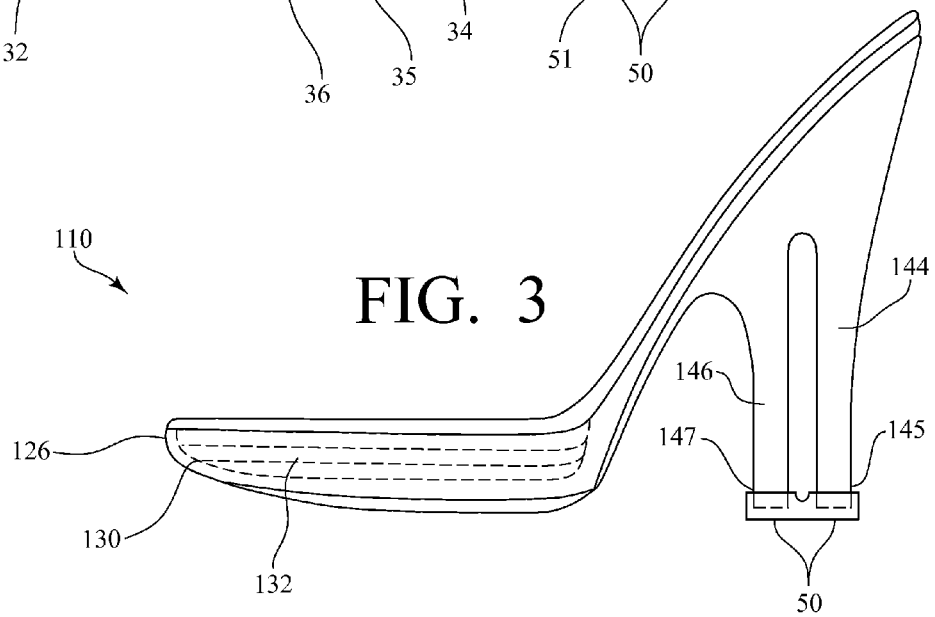
FIG. 3 is a left side view of another exemplary high-heeled shoe similar to the high-heeled shoe of FIGS. 1 and 2, but where the height of the receiving area and the cushioning insert are decreased.
Figure 4:
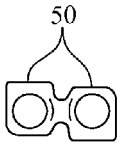
FIG. 4 is a bottom view of two exemplary caps made in accordance with the present invention, and illustrating the caps attached to one another.
Figure 5:
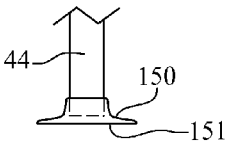
FIG. 5 is a side view of another exemplary cap made in accordance with the present invention.

Referring now to FIGS. 2-4, in some embodiments, the stability of the shoe 10 is also increased by providing a cap 50 for both the first heel 44, 144 and the second heel 46, 146 that includes a bottom face 51 and a hollow interior 52 such that the cap 50 easily fits over the ends 45, 47, 145, 147 of each heel 44, 46, 144, 146. In some embodiments, and as shown in FIG. 4, the caps 50 are connected to one another. In other embodiments, the bottom face 151 of each cap 150 is wider than a diameter of the heel 44 to further provide an increased amount of stability, as shown in FIG. 5.

Figure 6:
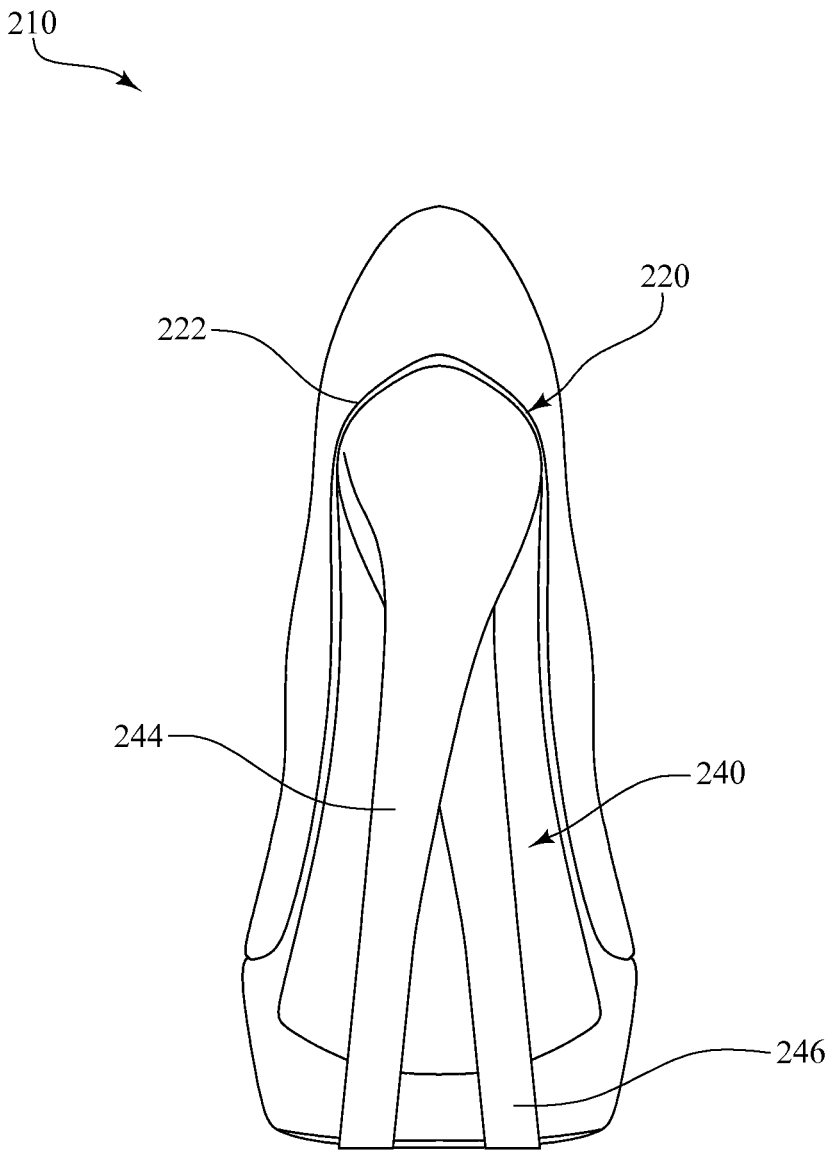
FIG. 6 is a rear view of another exemplary high-heeled shoe made in accordance with the present invention, where the two heels are angled, such that the first heel crosses the second heel.

In some embodiments of the present invention, increased stability and comfort is further provided by arranging the heels of the shoe in a particular orientation. For example, and referring again to FIGS. 1-2, in some embodiments, the first heel 44 is positioned on the support assembly 40 adjacent to the rear portion 22 of the base 20, and the second heel 46 is positioned on the support assembly 40 adjacent to the arch portion 24 of the base 20, such that the first heel 44 and the second heel 46 are aligned with one another. As another example, and referring now to FIG. 6, in other embodiments, an exemplary shoe 210 is provided where the first heel 244 and the second heel 246 are both positioned on the support assembly 240 adjacent to the rear portion 222 of the base 220, but the heels 244, 246 are angled such that the first heel 244 crosses the second heel 246.

Figure 8:
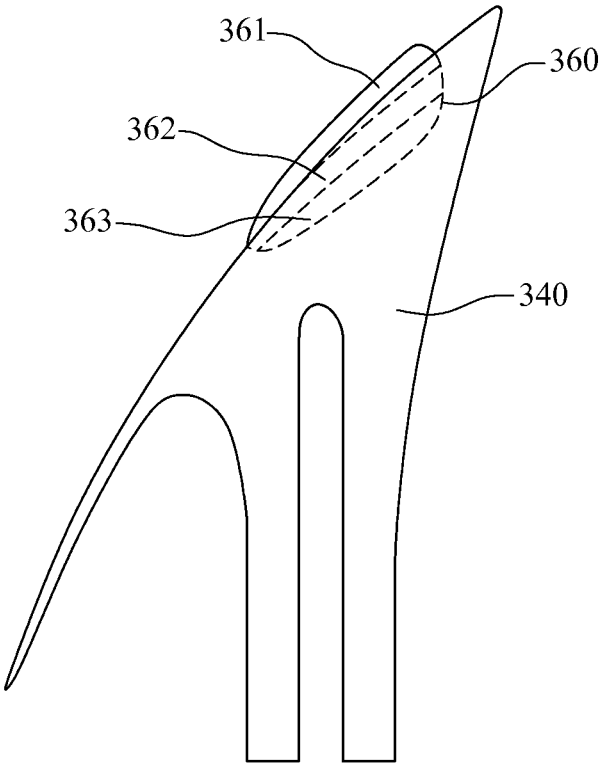
FIG. 8 is a left side view of the support assembly of the exemplary high-heeled shoe illustrated in FIG. 7, but further showing the pad positioned in the upper surface of the support assembly.

Referring now to FIGS. 7-8, and as a further refinement to the high-heeled shoes of the present invention, in some embodiments, a high-heeled shoe 310 is provided where the support assembly 340 further includes a pad 360 that is positioned on the upper surface 342 of the support assembly 340. In this embodiment, and to further provide comfort to a wearer, the pad 360 is comprised of a plurality of layers including an outer foam resin layer 361, a middle latex layer 362, and a bottom cork layer 363. In this regard, when the pad 360 of the shoe 310 is included in the support assembly 340, the pad 360 can be positioned into an aperture 321 defined in the rear portion 322 of the base 320 such that, once the support assembly 340 is attached to a bottom surface 323 of the rear portion 322 of the base 320 and to a bottom surface 325 of the arch portion 324 of the base 320, the pad 360 is positioned such that it will directly contact the heel of a wearer when the shoe 310 is worn and will thereby provide increased comfort to the wearer.

Figure 10:
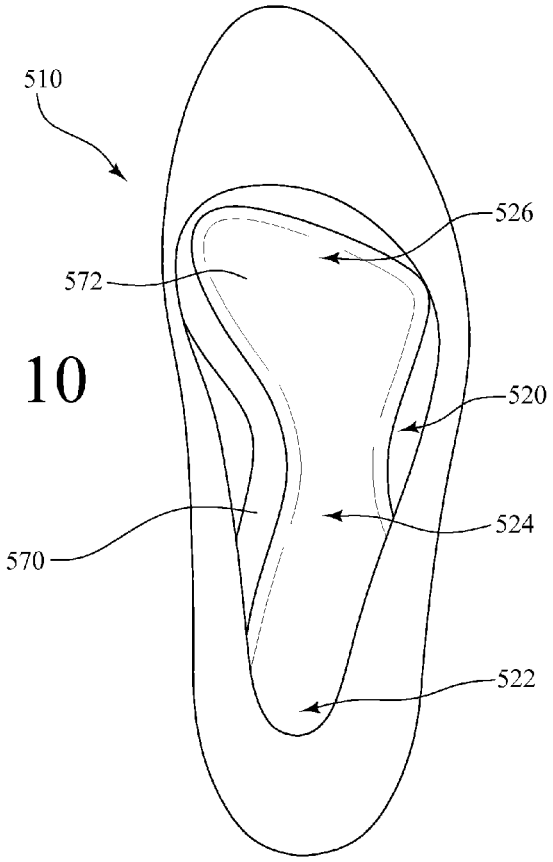
FIG. 10 is a top view of another exemplary high-heeled shoe in accordance with the present invention.

As yet another refinement, and referring again to FIG. 2, the appearance of the shoe 10 can be further refined by providing a uniform cover 70 over the cushioning insert 32 and the rear portion 22, the arch portion 24, and the substantially horizontal ball support portion 26 of the base 20 of the shoe 10. In some embodiments, and as shown in FIG. 10, another exemplary shoe 510 is provided that includes a comfort layer 572 (e.g., a 2 mm-thick layer of EVA) positioned beneath the cover 570 of the shoe 510 and extending from the rear portion 522 of the base 520 of the shoe 510 and over the arch portion 524 of the shoe 510 to the ball support portion 526 of the shoe 510 to provide even further comfort to the wearer of the shoe.

Figure 9:
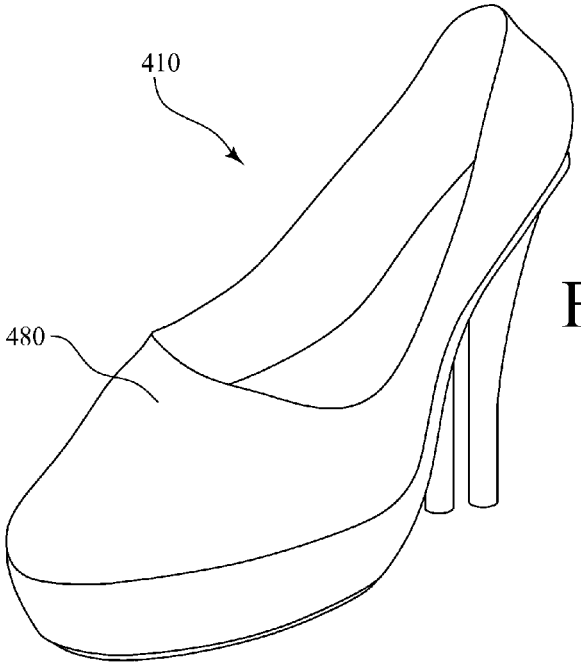
FIG. 9 is a perspective view of another exemplary high-heeled shoe in accordance with the present invention.

To complete the appearance of the shoes of the present invention, numerous upper portions can also be attached to the shoe and configured to cover the foot of a wearer. For example, in some embodiments and as shown in FIG. 9, an upper portion 480 of a shoe 410 is provided that is a closed-toe upper portion 480. Of course, numerous materials can be used to construct a suitable upper portion, including cloth, leather, plastics, and the like. Furthermore, it is contemplated that an exemplary upper portion of the shoe can also be provided in a number of styles, including, but not limited to, closed-toe shoes, shoes with straps, and the like.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A high-heeled shoe, comprising:

a base having a rear portion, an arch portion, and a substantially horizontal ball support portion, the rear portion and the arch portion being sloped at an angle relative to the substantially horizontal ball support portion;

a receiving area defined in the ball support portion of the base;

a cushioning insert positioned in the receiving area; wherein the cushioning insert is comprised of a plurality of cushioning layers including a top foam layer, a middle latex layer, and a bottom cork layer;

a support assembly having an upper surface attached to a bottom surface of the rear portion of the base and further attached to a bottom surface of the arch portion of the base, the upper surface extending from the rear portion of the base to and terminating at a rear portion of the substantially horizontal ball support portion of the base; and a heel arrangement consisting of only a first heel and a second heel, the first heel and the second heel each including an end and each extending from the support assembly beneath the rear portion of the base;

wherein the end of the first heel is separate and independent from the end of the second heel, wherein the first heel and the second heel are aligned along a common longitudinal axis forming a center-line of the high-heeled shoe and extending from the rear portion of the base to the substantially horizontal ball support portion of the base, and wherein the second heel is forward of the first heel along the common longitudinal axis forming the center-line of the high-heeled shoe.

2. The high-heeled shoe of claim 1, further comprising a cap for the first heel and the second heel, each cap having a bottom face and defining a hollow interior configured to fit over the end of each heel.

3. The high-heeled shoe of claim 2, wherein the bottom face of each cap is wider than a diameter of each heel.

4. The high-heeled shoe of claim 2, wherein the cap for the first heel is connected to the cap for the second heel.

5. The high-heeled shoe of claim 1 wherein the foam resin layer comprises ethylene vinyl acetate (EVA).

6. The high-heeled shoe of claim 1, further comprising a cover placed over the cushioning insert and the rear portion, the arch portion, and the substantially horizontal ball support portion of the base of the shoe.

7. The high-heeled shoe of claim 6, further comprising a comfort layer positioned beneath the cover of the shoe and extending from the rear portion of the base to the substantially horizontal ball support portion of the base of the shoe.

8. The high-heeled shoe of claim 1, further comprising an upper portion of the shoe that is configured to cover the foot of a wearer.

9. A high-heeled shoe, comprising:

a base having a rear portion, an arch portion, and a substantially horizontal ball support portion, the rear portion and the arch portion being sloped at an angle relative to the substantially horizontal ball support portion;

a cushioning insert positioned in the horizontal ball support portion; wherein the cushioning insert is comprised of a plurality of cushioning layers including a top foam layer, a middle latex layer, and a bottom cork layer; a support assembly having an upper surface attached to a bottom surface of the arch portion of the base, the upper surface extending from the rear portion of the base to and terminating at a rear portion of the substantially ball support portion of the base; and a heel arrangement consisting of only a first heel and a second heel, the first heel and the second heel each including an end and each extending from the support assembly beneath the rear portion of the base, wherein the end of the first heel is separate and independent from the end of the second heel, wherein the first heel and the second heel are aligned along a common longitudinal axis forming a center-line of the high-heeled shoe and extending from the rear portion of the base to the substantially horizontal ball support portion of the base, and wherein the second heel is forward of the first heel along the common longitudinal axis forming the center-line of the high-heeled shoe.

10. The high-heeled shoe of claim 9, further comprising a receiving area defined in the horizontal ball support portion of the base; wherein the cushioning insert is positioned in the receiving area.

* * * * *